United States Patent [19]

Honda et al.

[11] 4,286,647

[45] Sep. 1, 1981

[54] APPARATUS FOR PREVENTING STEAM EXPLOSION IN WATER DISCHARGE CHANNEL OF SECONDARY COOLING ZONE CAUSED BY MOLTEN METAL BREAKING OUT FROM CAST STRAND IN HORIZONTAL TYPE CONTINUOUS CASTING MACHINE

[75] Inventors: Akira Honda, Kamakura; Kiyomi Taguchi, Fukuyama; Masayuki Hanmyo, Fukuyama; Masaru Ishikawa, Fukuyama; Minoru Kitamura, Fukuyama, all of Japan

[73] Assignee: Nippon Kokan Kabushiki Kaisha, Tokyo, Japan

[21] Appl. No.: 160,596

[22] Filed: Jun. 18, 1980

[30] Foreign Application Priority Data

Jul. 9, 1979 [JP] Japan ..... 54/85844

[51] Int. Cl.[3] ..... B22D 11/124

[52] U.S. Cl. ..... 164/153; 164/444

[58] Field of Search ..... 164/89, 152, 153, 440, 164/444

[56] References Cited

U.S. PATENT DOCUMENTS

| | | | |
|---|---|---|---|
| 2,135,465 | 11/1938 | Eldred | 164/89 |
| 3,278,999 | 10/1966 | Lemper | 164/89 X |
| 3,368,607 | 2/1968 | Maddigan | 164/152 X |
| 3,462,134 | 8/1969 | Michelson | 164/263 X |

*Primary Examiner*—Robert D. Baldwin

*Attorney, Agent, or Firm*—Frishauf, Holtz, Goodman and Woodward

[57] ABSTRACT

An apparatus for preventing a steam explosion, in a water discharge channel of a secondary cooling zone of a horizontal type continuous casting machine, caused by molten metal breaking out from said cast strand, which comprises: a metal net provided substantially horizontally between said secondary cooling zone and said water discharge channel for granulating said molten metal breaking out from said cast strand; a water flashing mechanism provided over the entire width of said water discharge channel above said water discharge channel, said water flashing mechanism comprising a plurality of water injection ports ejecting water on said molten metal granulated through said metal net for rapidly cooling and solidifying said molten metal and washing away the resultant soldified granulated metal toward the downstream of said water discharge channel; a tank, provided at the downstream end of said water discharge channel for receiving the water and the granulated metal discharged from said water discharge channel and for separating said granulated metal from said water.

5 Claims, 4 Drawing Figures

APPARATUS FOR PREVENTING STEAM EXPLOSION IN WATER DISCHARGE CHANNEL OF SECONDARY COOLING ZONE CAUSED BY MOLTEN METAL BREAKING OUT FROM CAST STRAND IN HORIZONTAL TYPE CONTINUOUS CASTING MACHINE

FIELD OF THE INVENTION

The present invention relates to an apparatus for preventing a steam explosion in the water discharge channel of the secondary cooling zone of a cast strand caused by molten metal breaking out from the cast strand in a horizontal type continuous casting machine.

BACKGROUND OF THE INVENTION

A horizontal type continuous casting machine has recently been developed and is being industrialized, principally for reducing construction costs, which comprises horizontally fitting a casting nozzle to the lower part of the side wall of a tundish; arranging a mold horizontally along the horizontal axial line of said casting nozzle, in close contact with the tip of said casting nozzle; casting a molten metal received in a tundish through the casting nozzle horizontally into the mold to form a cast strand; and, withdrawing the cast strand thus formed always horizontally from the exit of the mold in the form of a long strand while cooling said cast strand in a secondary cooling zone provided along a path of withdrawal of the cast strand.

One of the problems encountered when manufacturing a cast strand by means of the above-mentioned horizontal type continuous casting machine is that, when the cast strand withdrawn from the mold during operation is cooled in the secondary cooling zone, the shell of said cast strand is broken and the molten metal flows out, i.e., occurrence of a breakout. Occurrence of a breakout of a cast strand as mentioned above in the operation of a horizontal type continuous casting machine cannot be completely prevented at present.

In the horizontal type continuous casting machine, as mentioned above, the cast strand withdrawn from the mold is cooled by water ejected toward the cast strand in the secondary cooling zone provided along the path of withdrawal of cast strand from the exit of the mold. For the purpose of receiving the water having cooled the cast strand and of pouring said water into a tank, a water discharge channel is installed directly below a secondary cooling zone. When a breakout occurs to the cast strand, therefore, the molten metal flowing out from the cast strand flows downwardly to said water discharge channel, comes into contact with the water having cooled the cast strand, and may cause a steam explosion as a result.

It is empirically known that, in order to prevent a steam explosion caused by an occurrence of a breakout of the cast strand, it suffices to pour the outflowing molten metal into a large quantity of water, e.g. over eight times as large as the quantity of said molten metal in weight. For this purpose, however, it is necessary to install a large-capacity tank capable of containing from 7 to 10 tons of water directly below said secondary cooling zone. Installation of such a large-capacity tank directly below the secondary cooling zone leads to considerable difficulties in designing and constructing the secondary cooling zone, and therefore such installation requires huge installation costs.

Under such circumstances, there is a strong demand for the development of an apparatus for preventing a steam explosion, caused by molten metal breaking out from a cast strand, in the water discharge channel of the secondary cooling zone of the cast strand in a horizontal type continuous casting machine, but such an apparatus has not as yet been proposed.

SUMMARY OF THE INVENTION

An object of the present invention is therefore to provide an apparatus for preventing a stream explosion caused by molten metal breaking out from a cast strand in a horizontal type continuous casting machine, which explosion occurs at the water discharge channel provided with an inclination toward the downstream along said secondary cooling zone of said cast strand, below said secondary cooling zone in said machine.

In accordance with one of the features of the present invention, there is provided an apparatus for preventing a steam explosion, in the water discharge channel of the secondary cooling zone of a cast strand, caused by molten metal breaking out from the cast strand in a horizontal type continuous casting machine, which comprises:

a metal net provided substantially horizontally between the secondry cooling zone and the water discharge channel for granulating the molten metal breaking out from the cast strand;

a water flashing mechanism provided over the entire width of said water discharge channel above said water discharge channel, said water flashing mechanism comprising a plurality of water injection ports ejecting water on said molten metal granulated through said metal net for rapidly cooling and solidifying said molten metal and washing away said solidified granulated metal toward the downstream of said water discharge channel; and, a tank, provided at the downstream end of said water discharge channel, for receiving the water and the granulated metal discharged from said water discharge channel and for separating said granulated metal from said water.

DETAILED DESCRIPTION OF PREFERRED EMBODIMENTS

We carried out extensive studies with a view to solving the above-mentioned problem of a steam explosion. As a result, we developed the preventing apparatus described below by way of example with reference to the drawings.

Figure 1:
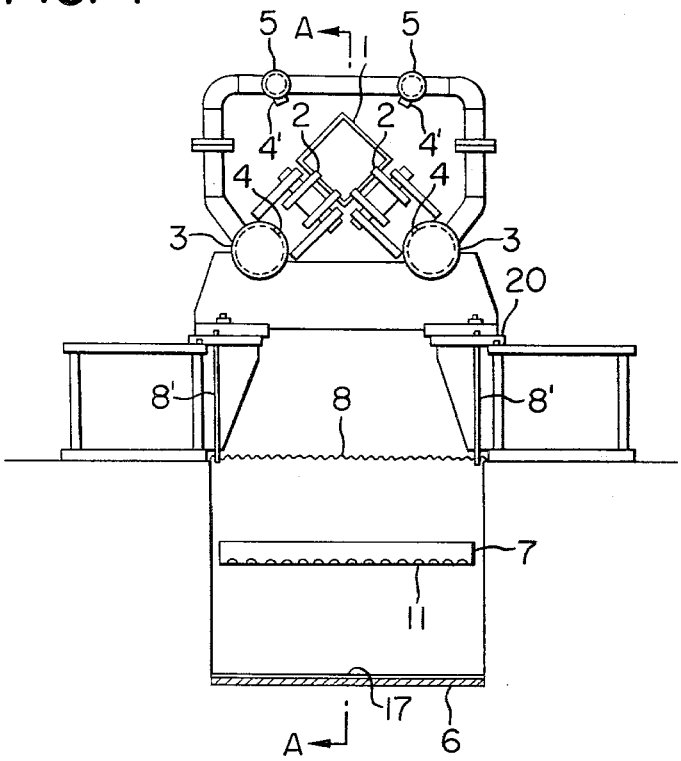
FIG. 1 is a schematic front view illustrating an embodiment of the apparatus for preventing a steam explosion in the water discharge channel of the secondary cooling zone of a cast strand, caused by molten metal breaking out from the cast strand in a horizontal type continuous casting machine, of the present invention (hereinafter referred to as the "preventing apparatus of the present invention")
Figure 2:
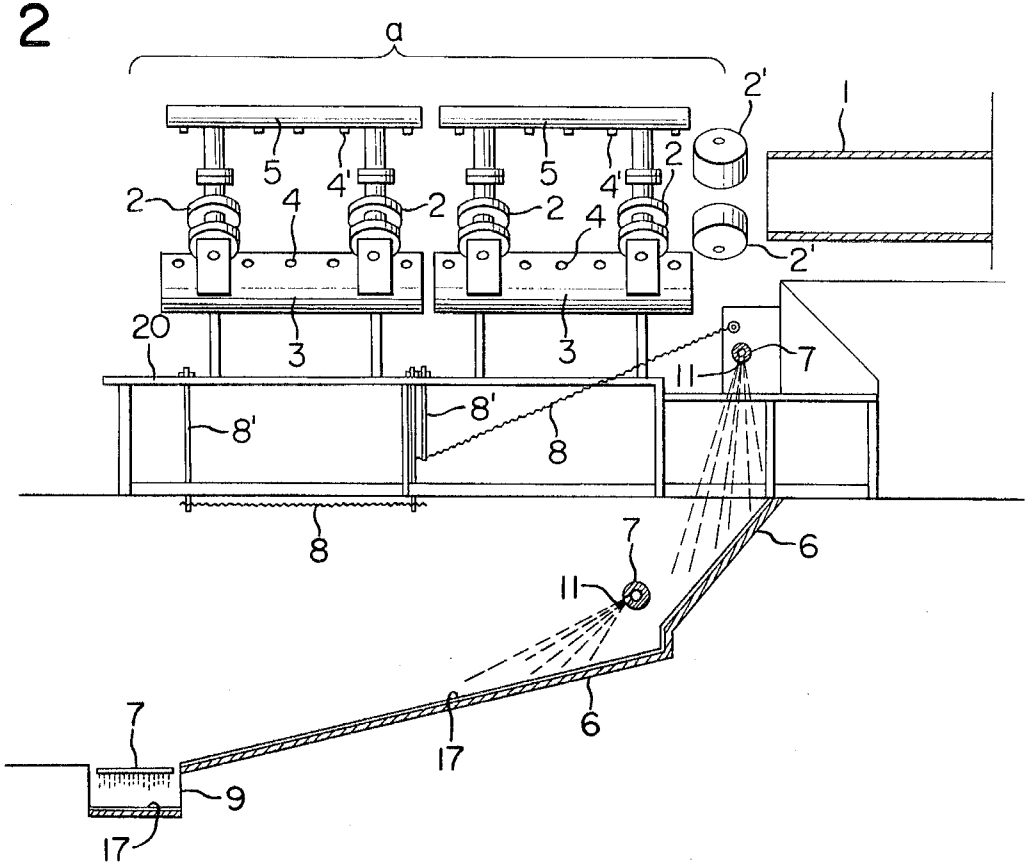
FIG. 2 is a longitudinally cutaway sectional view of the preventing apparatus shown in FIG. 1 cut along the line A—A.

FIG. 1 is a schematic front view illustrating an embodiment of the preventing apparatus of the present invention; and FIG. 2 is a longitudinally cutaway view cut along the line A—A in FIG. 1. In FIGS. 1 and 2, 1 is a mold 1 is arranged in close contact with the tip of a casting nozzle horizontally fitted to the lowest part of the side wall of a tundish (not shown). 2 are two pairs of cast strand transfer rolls for supporting from below and transferring a cast strand withdrawn from the mold 1, several two pairs of cast strand transfer rolls 2 being installed in succession in the withdrawal direction of the cast strand along the horizontal axial line of the mold 1, following each pair of top and bottom cast strand withdrawal rolls 2' arranged adjacent to the end of the mold 1; 3 are cooling water ducts arranged horizontally along the cast strand transfer rolls 2 below the several two pairs of cast strand transfer rolls 2, the cooling water ducts 3 being provided with a number of water injection ports 4 directed toward the bottom surface of the cast strand supported and transferred by said plurality of two pairs of cast strand transfer rolls 2; and, 5 are cooling water ducts arranged horizontally along said plurality of cast strand transfer rolls 2 above the cast strand transfer rolls 2, the cooling water ducts 5 being provided with a number of water nozzles 4' directed toward the upper surface of the cast strand supported and transferred by said plurality of two pairs of cast strand transfer rolls 2. In FIG. 2, "a" is a secondary cooling zone of the cast strand comprising the above-mentioned cooling water ducts 3 provided with a number of water injection ports 4 and the cooling water ducts 5 provided with a number of water nozzles 4'.

The cast strand withdrawn from the mold 1 by the cast strand withdrawal rolls 2' is supported by the plurality of two pairs of cast strand transfer rolls 2 and travels through the secondary cooling zone "a". In the secondary cooling zone "a", the cast strand is cooled from both the lower surface and the upper surface thereof by cooling water ejected from the plurality of water injection ports 4 provided on the cooling water ducts 3 and from the plurality of water nozzles 4' provided on the cooling water ducts 5. A water discharge channel 6 inclining toward the downstream is provided below the secondary cooling zone "a" along the secondary cooling zone "a".

For granulating the molten metal breaking out from the cast strand, a metal net 8 such as a grater-shaped metal sheet, i.e., and "expanded metal" made of a metal sheet with a thickness of from 6 mm to 8 mm is substantially horizontally installed between the secondary cooling zone "a" and the water discharge channel 6, and is fitted to a stand 20 by a fitting 8'. Also in FIG. 2, 7 is a water flashing mechanism, such as a water injection pipe, provided over the entire width of the water discharge channel 6, and comprises a plurality of water injection ports 11 which eject high-pressure water in a large quantity for rapidly cooling and solidifying the molten metal granulated through the metal net 8 and washing away the granulated metal thus solidified toward the downstream of said water discharge channel.

Figure 4:
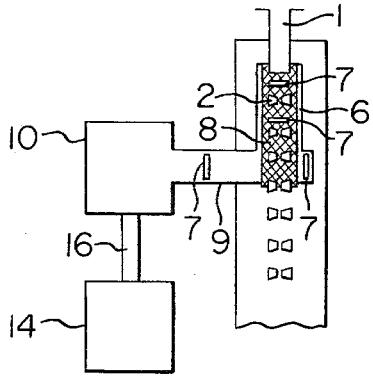
FIG. 4 is a floor plan view illustrating a schematic layout of the preventing apparatus of the present invention.
Figure 3:
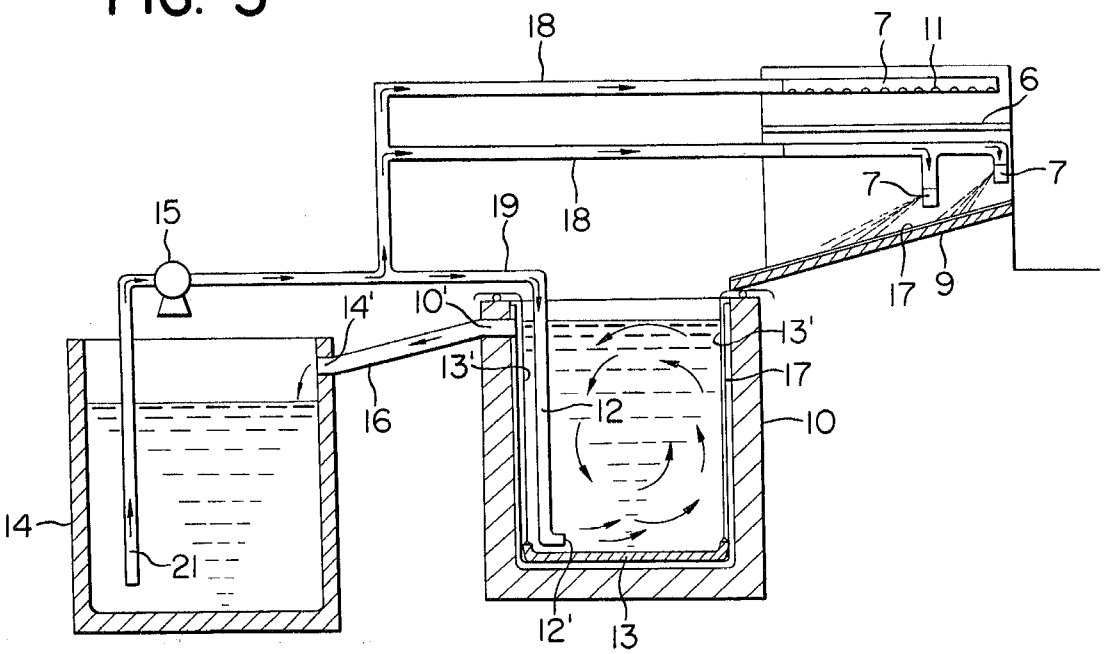
FIG. 3 is a descriptive view illustrating the water circulating system in the preventing apparatus of the present invention.

FIG. 3 is a descriptive drawing illustrating the water circulating system of the preventing apparatus of the present invention, and FIG. 4 is a floor plan view illustrating a schematic layout of the preventing apparatus of the present invention. In FIGS. 3 and 4, 9 is a water discharge channel, provided in a direction at right angles to the water discharge channel 6 at the downstream end of the water discharge channel 6, inclining downward toward the downstream, the water discharge channel 9 being provided with a water flashing mechanism 7 as mentioned above; 10 is a tank installed at the downstream end of the water discharge channel 9, for receiving the water and the granulated metal discharged from the water discharge channel 9 and for separating the granulated metal from said water, and has a capacity sufficient to contain a quantity of water about seven to eight times as large as the quantity of the granulated metal in weight.

An ejecting pipe 12 for ejecting stirring water from an ejecting port 12' located near the bottom of the tank 10 is provided in the tank 10, and acts as a stirring means for stirring the water received in the tank 10. In FIG. 3, 13 is a receptacle which is vertically movably suspended by a plurality of wires 13' on the inner bottom surface of the tank 10, having an area almost equal to that of the inner bottom surface of the tank 10, and has the function to receive the granulated metal separated from the water and to discharge same from the tank 10.

Also in FIGS. 3 and 4, 14 is a scale separating tank provided adjacent to the tank 10, and provided with an opening 14' on the upper side wall thereof. Another opening 10' is provided on the upper side wall of the tank 10. These openings 14' and 10' are connected together by a trough 16. A waste water suction pipe 21 provided in the scale separating tank 14, and an end of the waste water suction pipe 21 is connected through a pump 15 with two ducts 18 and another duct 19. The ducts 18 are connected to the water flashing mechanism 7, whereas the duct 19 is connected to the water ejection pipe 12 provided in the tank 10.

The inner surface of the water discharge channels 6 and 9 and the tank 10 are covered with wooden plates 17 coated with coal tar on the surfaces thereof and having a thickness of, for example, about 20 mm. These wooden plates 17 permit prevention of the granulated metal from adhering to the iner surfaces of the water discharge channels 6 and 9 and the tank 10. In this example, the water discharge channel 9 is provided in a direction at right angles to the water discharge channel 6 at the downstream end of the water discharge channel 6. However, it is not always necessary to install the above mentioned water discharge channel 9, but such a channel may be installed only as required by a particular layout of the plant.

Because the preventing apparatus of the present invention has the structure as mentioned above, when a breakout occurs while a cast strand withdrawn from the mold 1 by the cast strand withdrawal rolls 2' is traveling through the secondary cooling zone of the cast strand, the molten metal breaking out therefrom hits against the metal net 8 provided substantially horizontally between the secondary cooling zone "a" and the water discharge channel 6, is dispersed and granulated by this hit against the metal net 8, and thereafter fows down into the water discharge channel 6. Since high-pressure water is ejected at a high flow rate from the water flashing mechanism 7 provided above the beginning end of the water discharge channel 6 over the entire width thereof in the water discharge channel 6 as mentioned above, the molten metal granulated by the hit against the metal net 8 is rapidly cooled and solidified by water ejected from the water flashing mechanism 7 into a granulated solidified metal, and washed away toward the downstream of the water discharge channel 6. As described above, the molten metal breaking out from the cast strand is finely dispersed and granulated by the metal net 8, flows downwardly into the water discharge channel 6, and is washed away by the high-pressure water ejected at a high flow rate from the water flashing mechanism 7. A steam explosion therefore never occurs to the water discharge channel 6. The water should preferably be ejected from the water flashing mechanism 7 under conditions including a pressure of from 3 to 10 kg/cm², an amount of water as expressed in the ratio of granulated metal/water of at least 1/0.1 in weight, and a flow velocity of at least 10 m/sec.

The granulated metal washed away on the water discharge channel 6 is discharged through the water discharge channel 9 into the tank 10, together with the water, cooled in the tank 10 sufficiently by the stirring flow of water ejected from the water ejection pipe 12, and thus sinks onto and is accumulated on the receptacle 13 suspended on the inner bottom surface of the tank 10. The granulated metal accumulated on the receptacle 13 can be removed from the tank 10 and recovered by hoisting up the receptacle 13 by means of the wire 13'.

The water discharged from the water discharge channel 9 into the tank 10 overflows from the opening 10' provided on the upper side wall of the tank 10 and flows through the trough 16 into the scale separating tank 14 via the opening 14' thereof. In the scale separating tank 14, the water is sucked through the waste water suction pipe 21 by the operation of the pump 14 after scale contained in the water is separated and removed from the water. A part of the sucked water flows through the duct 19 into the water ejection pipe 12 provided in the tank 10 and is ejected from the water ejection ports 12' to stir the water in the tank 10. The remaining most part of the sucked water flows through the duct 18 into the water flashing mechanism 7, and is ejected from the water injection ports 11 toward the water discharge channels 6 and 9. The water discharged from the water discharge channel 9 into the tank 10 is thus recirculated within the apparatus and reused.

With the apparatus of the present invention, as it is possible, when manufacturing a cast strand by a horizontal type continuous casting machine, to prevent a steam explosion from occurring even when a breakout occurs and molten metal flows downwardly into the water discharge channel, to continue operation safely, and to recover the molten metal thus flowing out in the form of a granulated metal. Since it is not necessary to install a large-capacity water tank directly below the secondary cooling zone of the cast strand for preventing a steam explosion caused by the outflowing molten metal, the secondary cooling zone of the cast strand can be designed and constructed with no trouble, and it suffices to supply a relatively small amount of water onto the water discharge channel, thus providing economic advantages. Thus, with the preventing apparatus of the present invention, many industrially useful effects are provided.

What is claimed is:

1. An apparatus for preventing a steam explosion in a water discharge channel of a secondary cooling zone of a horizontal type continuous casting machine, caused by molten metal breaking out from a cast strand, said discharge channel being provided in downward inclination toward the downstream below said secondary cooling zone along said secondary cooling zone, which comprises:

a metal net provided substantially horizontally between said secondary cooling zone and said water discharge channel for granulating said molten metal breaking out from said cast strand;

a water flashing mechanism provided over the entire width of said water discharge channel above said water discharge channel, said water flashing mechanism comprising a plurality of water injection ports for ejecting water on said molten metal granulated through said metal net for rapidly cooling and solidifying said molten metal and washing away the resultant solidified granulated metal toward the downstream of said water discharge channel; and, a tank provided at the downstream end of said water discharge channel for receiving the water and the granulated metal discharged from said water discharge channel and for separating said granulated metal from said water.

2. The apparatus as claimed in claim 1, wherein said tank is provided with a stirring means for stirring the water received in said tank.

3. The apparatus as claimed in claim 1 or 2, wherein said tank is provided with a receptacle for removing said granulated metal, received in said tank and separated from the water, from said tank.

4. The apparatus as claimed in any of claims 1 or 2, wherein both the inner surfaces of said water discharge channel and said tank are covered with plates coated with coal tar on the surfaces thereof.

5. The apparatus as claimed in claim 3, wherein both the inner surfaces of said water discharge channel and said tank are covered with plates coated with coal tar on the surfaces thereof.

* * * * *